US007864144B2

(12) United States Patent
Yagi

(10) Patent No.: US 7,864,144 B2
(45) Date of Patent: Jan. 4, 2011

(54) LIGHT EMISSION CONTROL DEVICE, DISPLAY DEVICE, DRIVE CONTROL DEVICE, AND CONTROL DEVICE

(75) Inventor: Toru Yagi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 964 days.

(21) Appl. No.: 11/725,042

(22) Filed: Mar. 15, 2007

(65) Prior Publication Data

US 2007/0222721 A1 Sep. 27, 2007

(30) Foreign Application Priority Data

Mar. 24, 2006 (JP) ..... 2006-082128

(51) Int. Cl.
*G09G 3/32* (2006.01)

(52) U.S. Cl. ..... 345/82

(58) Field of Classification Search ..... 345/82, 345/102

See application file for complete search history.

(56) References Cited

U.S. PATENT DOCUMENTS

2003/0084360 A1* 5/2003 Grant et al. ..... 713/400
2006/0202946 A1* 9/2006 Yoshimura ..... 345/102
2006/0214603 A1* 9/2006 Oh et al. ..... 315/246
2009/0033611 A1* 2/2009 Mizumaki ..... 345/102

FOREIGN PATENT DOCUMENTS

JP 2002-335234 11/2002

* cited by examiner

*Primary Examiner*—Richard Hjerpe
*Assistant Examiner*—Jeffrey Parker
(74) *Attorney, Agent, or Firm*—Fish & Richardson P.C.

(57) ABSTRACT

A light emission control device has a drive current feeder supplying a drive current to a light-emitting element, a drive current controller controlling the current level of the drive current based on the number of pulses in an enable signal, and a resetter resetting the controlling of the current level of the drive current when the enable signal has remained in a predetermined logic state for a predetermined period. Thus configured, the light emission control device allows its turning-on and -off and drive current level to be controlled with a single-line interface.

10 Claims, 2 Drawing Sheets

LIGHT EMISSION CONTROL DEVICE, DISPLAY DEVICE, DRIVE CONTROL DEVICE, AND CONTROL DEVICE

This application is based on Japanese Patent Application No. 2006-082128 filed on Mar. 24, 2006, the contents of which are hereby incorporated by reference.

BACKGROUND OF THE INVENTION

1. Field of the Invention

The present invention relates to a light emission control device such as an LED (light-emitting diode) driver IC, and to a display device incorporating such a light emission control device. The invention also relates to a drive control device for supplying a predetermined drive current to a load, and to a control device that changes its output state according to a control signal.

2. Description of Related Art

A conventional light emission control device for supplying a drive current to a light-emitting element such as an LED typically employs a two- or more-line interface as a control interface so that, as commands, such as those requesting writes to a register, are transmitted to the light emission control device, its turning-on and -off and light emission amount (drive current level) are controlled.

A conventional technology related to the present invention is disclosed, for example, in JP-A-2002-335234 (a single-line serial data transfer method and a data transfer interface circuit employing it).

Certainly, with conventional light emission control devices as described above, it is possible to control their turning-on and -off and light emission amount (driving current level) according to various control signals fed from outside the device.

Inconveniently, however, with the conventional light emission control devices described above, the control signal needed to control their turning-on and -off and the control signal needed to control their light emission amount (driving current level) are fed in via separate control interfaces. This complicates the control and also requires an increased number of external terminals, leading to an increased size and cost of light emission control devices (and hence of display devices employing them).

Incidentally, there have been proposed various system control technologies employing a single-line interface, like the single-line serial data transfer method disclosed in JP-A-2002-335234 mentioned above. Any of these conventional technologies, however, differs in essence from the present invention described herein.

SUMMARY OF THE INVENTION

An object of the present invention is to provide a light emission control device whose turning-on and -off and drive current level can be controlled using a single-line interface, and to provide a display device, a drive control device, and a control device employing such a light emission control device.

To achieve the above object, according to one aspect of the invention, a light emission control device includes: a drive current feeder (in the example shown in FIG. 1, the variable current source 7) supplying a drive current to a light-emitting element; a drive current controller (in the example shown in FIG. 1, the counter 1, the DAC 6, and the variable current source 7) controlling the current level of the drive current based on the number of pulses in an enable signal; and a resetter (in the example shown in FIG. 1, mainly the low-level period detector 2 and the on/off controller 3) resetting the controlling of the current level of the drive current when the enable signal has remained in a predetermined logic state for a predetermined period.

Other features, elements, steps, advantages and characteristics of the present invention will become more apparent from the following detailed description of preferred embodiments thereof with reference to the attached drawings.

DETAILED DESCRIPTION OF PREFERRED EMBODIMENTS

Figure 1:
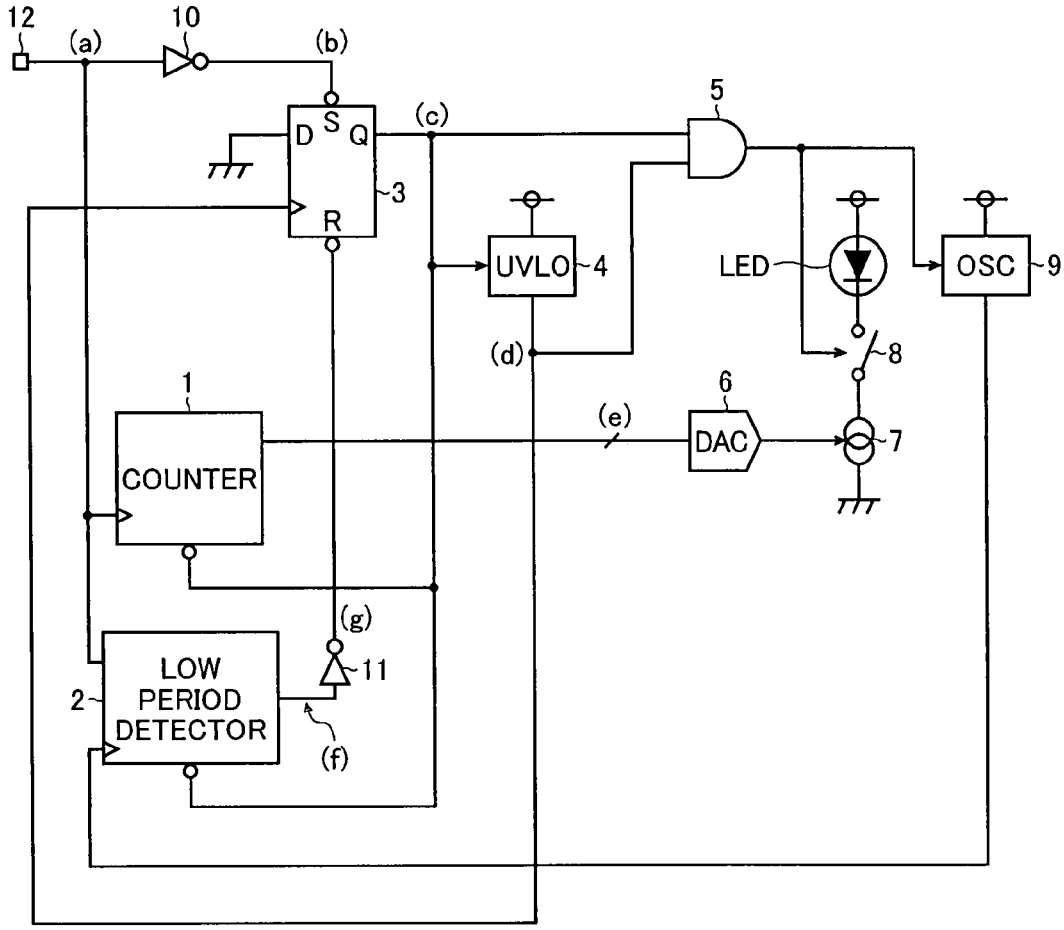
FIG. 1 is a block diagram showing a display device as an embodiment of the invention.

FIG. 1 is a block diagram showing a display device (in particular its part around a light emission control device it incorporates) as an embodiment of the invention.

As shown in FIG. 1, in this embodiment, the display device includes: a light-emitting diode (hereinafter "LED") that illuminates an unillustrated liquid crystal panel from behind; and a light emission control device that supplies drive current to the LED. Here, the light emission control device is built as a semiconductor integrated circuit device (a so-called LED driver IC), and includes: a counter 1; a low-level period detector 2; an on/off controller 3; a voltage detector 4 (hereinafter "UVLO 4", which stands for "undervoltage lockout"); an AND operator 5; a digital/analog converter 6 (hereinafter "DAC 6"); a variable current source 7; a switch 8; an oscillator 9; inverters 10 and 11; and an external terminal 12.

The counter 1 is triggered by every rising edge in an enable signal (a) fed in via the external terminal 12, i.e., every time the enable signal (a) turns high (enabled), to count the number of pulses in it, and outputs the count as digital data (e). The counter 1 receives, at its reset terminal, the output signal (c) of the on/off controller 3 so that, when the logic state of the output signal (c) becomes low, the counter 1 resets the number of pulses (to zero).

The low-level period detector 2 turns the logic state of its output signal (f) high when the enable signal (a) has remained low (disabled) for a predetermined period (in this embodiment, 512 μs); otherwise, the low-level period detector 2 keeps the logic state of its output signal (f) low. Like the counter 1, the low-level period detector 2 receives, at its reset terminal, the output signal (c) of the on/off controller 3 so that, when the logic state of the output signal (c) becomes low, the low-level period detector 2 initializes its detection state (resets its output signal (f) to low.

The on/off controller 3 is a D flip-flop that receives: at its data terminal D, a signal whose logic state is low; at its set terminal S, an inverted enable signal (b); at its reset terminal R, an inverted output signal (g) of the low-level period detector 2; and, at its clock terminal, the output signal (d) of the UVLO 4. The on/off controller 3 outputs data (i.e., a low level) at its output terminal Q when triggered by a rising edge in the output signal (d) of the UVLO 4, i.e., when the output signal (d) turns high. Whenever the logic state of the inverted enable signal (b) fed to its set terminal S is low, the on/off controller 3 keeps its output signal (c) set, i.e., high, irrespective of the output signal (d) of the UVLO 4. When the logic state of the inverted output signal (g) of the low-level period detector 2 fed to its reset terminal R becomes low, the on/off controller 3 initializes its output signal (c) (resets it to low), irrespective of the output signal (d) of the UVLO 4.

The UVLO 4 turns the logic state of its output signal (d) high when the supply voltage to the light emission control device has reached a predetermined voltage level; otherwise, the UVLO 4 keeps the logic state of its output signal (d) low. The UVLO 4 receives, at its enable terminal, the output signal (c) of the on/off controller 3 so that, so long as the logic state of the output signal (c) is high, the UVLO 4 monitors the supply voltage.

The AND operator 5 outputs the AND of the output signal (c) of the on/off controller 3 and the output signal (d) of the UVLO 4; that is, the output logic state of the AND operator 5 is high only when the output signals (c) and (d) are both high, and is low otherwise.

The DAC 6 converts the digital data (e) into analog data, and outputs the analog data.

The variable current source 7 (drive current feeder) produces drive current whose level is commensurate with the analog data fed from the DAC 6, and supplies the drive current to the LED.

The switch 8 controls whether or not to supply the drive current to the LED according to the output signal of the AND operator 5. Specifically, in this embodiment, the switch 8 is serially connected in the current path connecting the variable current source 7 to the LED; when the output logic state of the AND operator 5 is high, the switch 8 is on, and, when the output logic state of the AND operator 5 is low, the switch 8 is off.

The oscillator 9 produces a clock signal of a predetermined frequency (in this embodiment, 1 MHz). The clock signal produced by the oscillator 9 is fed to the low-level period detector 2, which uses it to detect whether or not the enable signal (a) has remained low for a predetermined period. The oscillator 9 receives, at its enable terminal, the output signal of the AND operator 5 so that, while the logic state of this signal is high, the oscillator 9 operates.

The inverter 10 inverts the logic state of the enable signal (a) to produce the inverted enable signal (b) to feed it to the set terminal S of the on/off controller 3.

The inverter 11 inverts the logic state of the output signal (f) of the low-level period detector 2 to produce the inverted output signal (g) to feed it to the reset terminal R of the on/off controller 3.

The external terminal 12 is a single-line interface terminal via which the enable signal (a) is fed in from outside the device. The enable signal (a) is a binary signal, being either high or low at a time.

Now, with reference to FIG. 2, the operation of the light emission control device configured as described above will be described in detail.

Figure 2:
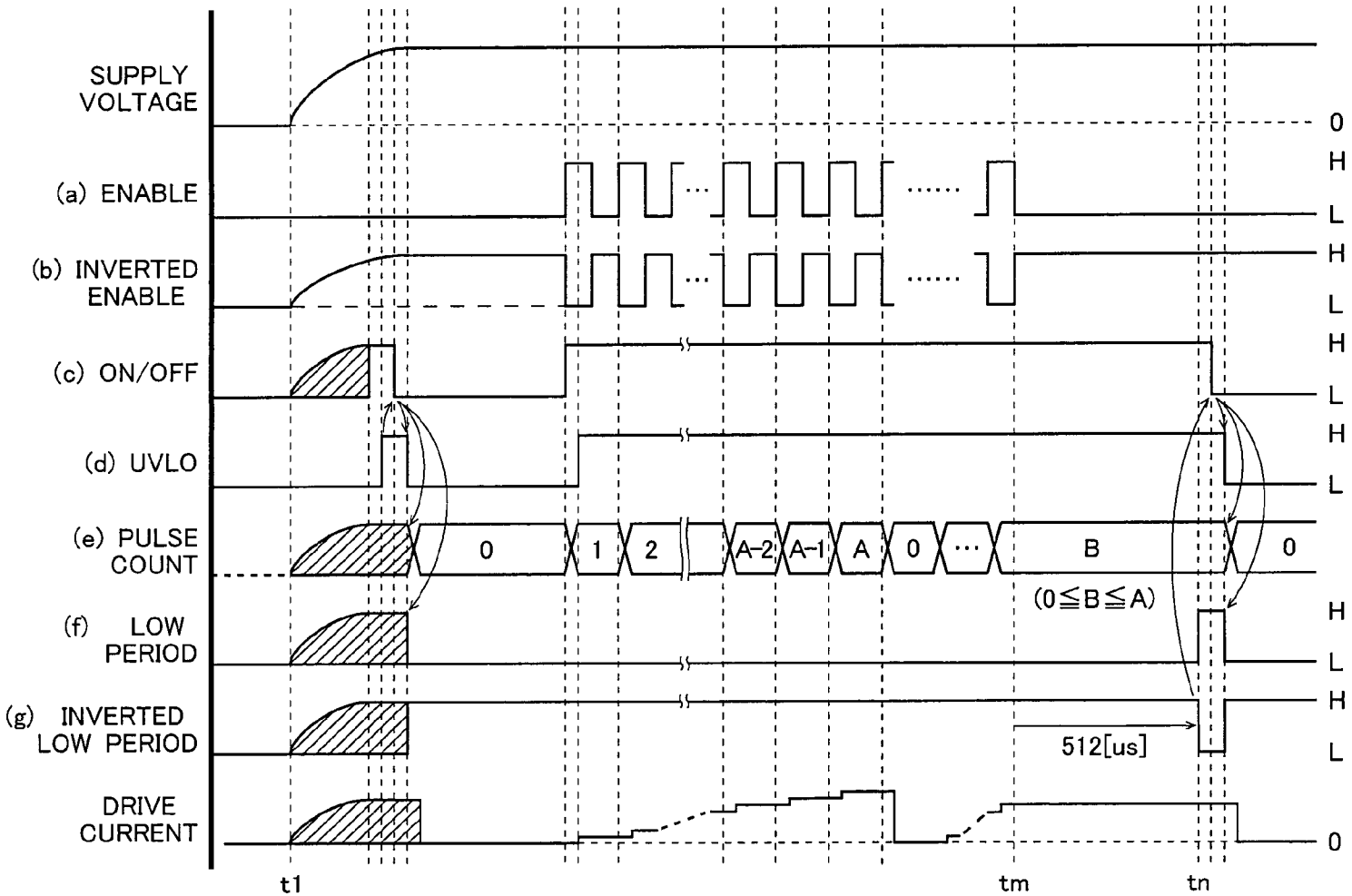
FIG. 2 is a timing chart illustrating how light emission is controlled via a single line.

FIG. 2 is a timing chart illustrating how light emission is controlled with a single-line interface. The symbols (a) to (g) in this figure respectively indicate the signals (or data) (a) to (g) at relevant points in the device shown in FIG. 1.

First, a description will be given of how the level of the drive current is controlled according to the number of pulses in the enable signal (a).

As shown in FIG. 2, in this embodiment, the enable signal (a) fed to the light emission control device is a pulse signal. The counter 1 increments its count (e) by one every time the enable signal (a) turns high. The DAC 6 receives the count (e) as digital data, and converts it into analog data, according to which the variable current source 7 controls the level of the drive current.

For example, consider a case where the count (e) is four-bit digital data (0 to 15). In this case, when the enable signal (a) pulsates eight times and then remains high, the LED drive current level is set at "level 8". If the LED drive current level is currently set at its maximum (at "level 15") and then the enable signal (a) pulsates once more, the count (e) returns to zero, causing the LED drive current level to be set at its minimum (zero).

Next, a description will be given of how resetting is achieved by keeping the enable signal (a) low.

In the light emission control device of this embodiment, as shown in FIG. 2, between time points tm and tn, when the enable signal (a) remains low (disabled) for a period of 512 μs, the output signal (f) of the low-level period detector 2 turns high, and thus its inverted output signal (g) turns low. As a result, the output signal (c) of the on/off controller 3 is reset to low, causing the UVLO 4 to stop operating; moreover, the number of pulses counted by the counter 1 and the detection state of the low-level period detector 2 are initialized (i.e., their outputs are reset to zero and to low respectively). In this way, in the light emission control device of this embodiment, only when the enable signal (a) has remained low for a period of 512 μs, it is recognized to have become disabled.

As described above, the light emission control device of this embodiment includes: a driver current controller (mainly the counter 1, the DAC 6, and the variable current source 7) that controls the level of the drive current to be supplied to the LED according to the number of pulses in the enable signal (a); and a resetter (mainly the low-level period detector 2 and the on/off controller 3) that resets the device when the enable signal (a) has remained low for a predetermined period.

With this configuration, i.e., one where the level of the drive current for the LED is controlled through code setting by the DAC 6 according to the number of pulses in the enable signal (a), and where the device as a whole is turned on and off according to the length of the period for which the enable signal (a) remains low, it is possible to feed the device with, as a control signal fed from outside it, only the enable signal (a) and hence via a single line. This helps reduce the number of external terminals, contributing to a reduced size and cost of the light emission control device (and hence the display device incorporating it).

Next, a description will be given of initial resetting at start-up.

As indicated by hatching starting at time point t1 in FIG. 2, immediately after electric power starts to be fed to the device, the logic states of the output signal (c) of the on/off controller 3, the count (e) of the counter 1, the output signal (f) of the low-level period detector 2, and its inverted output signal (g) are indefinite for a while, during which time the different parts of the device start to operate.

In this state of indefinite logic states, as shown in FIG. 2, even though the enable signal (a) is low (disabled), the output signal (c) of the on/off controller 3 may unintendedly turn high, and the count (e) of the counter 1 is not necessarily be zero. Thus, in the state of indefinite logic states, once the supply voltage rises to a predetermined voltage, as soon as the output signal (d) of the UVLO 4 turns high, drive current may unintendedly be supplied to the LED, causing it to emit light when supposed not to.

Commonly, this state of indefinite logic states is overcome by using the enable signal (a) as a reset signal of the device. In the light emission control device of this embodiment, however, since the enable signal (a) is a pulse signal as described previously, it cannot be used intact as a reset signal.

Instead, in the light emission control device of this embodiment, in the state of indefinite logic states, when the supply voltage has risen to a predetermined voltage, and then the output signal (d) of the UVLO 4 turns high, the rising edge in this output signal (d) triggers the on/off controller 3 to cause it to output data (i.e., a low level). The output of this data acts as the initialization (initial resetting) of the output signal (c); thus, when the output signal (c) turns low, the UVLO 4 stops operating, and moreover the pulse count of the counter 1 and the detection state of the low-level period detector 2 are initialized (their outputs are reset to zero and to low respectively). Meanwhile, the inverted enable signal (b) fed to the set terminal S of the on/off controller 3 is kept high to allow the just mentioned output of the data to take place unhampered.

Later, after the supply voltage has sufficiently risen, as the enable signal (a) turns high, the output signal (c) of the on/off controller 3 turns high, and the output signal (d) of the UVLO 4 turns high again. This time, however, the on/off controller 3 is not triggered by the rising edge in this output signal (d) to output data (i.e., a low level). This is because, at this point, the inverted enable signal (b) fed to the set terminal S of the on/off controller 3 is low, and thus the on/off controller 3 is "set". Consequently, the outputting of data is inhibited, and thus the logic state of the output signal (c) is kept high.

As described above, the light emission control device of this embodiment includes a second resetter (mainly the on/off controller 3 and the UVLO 4) that resets the device if, when the supply voltage has reached a predetermined voltage level, the enable signal (a) is low (disabled).

With this configuration, the device can surely be reset without the need for a reset terminal. This helps prevent unintended light emission at start-up.

Incidentally, in the state of indefinite logic states at start-up, there is a delay, attributable to circuit operation, after the output signal "d" of the UVLO 4 turns high until the output signal "c" of the on/off controller 3 is reset to low. Since this delay is so short (several nanoseconds) that, during its period, neither the DAC 6 nor the variable current source 7 can completely start up; thus, the delay does not cause unintended light emission by the LED.

In FIG. 2, to simplify the illustration, the resetting mentioned above is shown to take place when the supply voltage has almost completely risen; in practice, however, the resetting is performed while the supply voltage is lower (as soon as the device becomes ready to operate).

In the light emission control device of this embodiment, an existing UVLO 4 is utilized to monitor the supply voltage. With this configuration, i.e., one where the output signal "d" of the UVLO 4, which signal is originally intended to be used to protect the device in an abnormally low-voltage condition, is also used to perform initial resetting as described above, it is possible to avoid unnecessarily increasing the circuit scale, contributing to a reduced size and cost of the light emission control device (and hence the display device incorporating it).

The embodiment described above deals with a case where a light emission control device according to the invention is used to control a light-emitting element incorporated in a display device. This, however, is not meant to limit in any way how to implement the invention; the invention finds wide application in light emission control devices incorporated in other kinds of device, in motor drive devices, and in control devices in general that are required to be free from malfunctioning at start-up.

The invention may be implemented in any other manner than in the embodiment described above, with any modification or variation made within the spirit of the invention. For example, how the signals (a) to (g) change their logic states in the embodiment described above is merely an example taken up for illustrating purposes; they may behave in any other manner so long as they achieve similar operation.

Instead of varying the current level, the period for which current is supplied may be varied to achieve PMW driving.

From the perspective of industrial applicability, the invention is useful in reducing the number of external terminals of a light emission control device (and hence in reducing its size and cost). For example, a light emission control device according to the invention can be employed to control light emission in a display device in which sliminess is sought.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the present invention which fall within the true spirit and scope of the invention.

What is claimed is:

1. A light emission control device to supply a drive current to a light-emitting element, the light emission control device comprising:

a current source producing the drive current;

a drive current controller controlling a current level of the drive current by controlling the current source based on the number of pulses in an enable signal;

a switch opening/closing a supply path of the drive current to the light-emitting element; and a switch controller causing the switch to open/close according to the enable signal.

2. The light emission control device of claim 1, further comprising:

a resetter resetting the controlling of the current level of the drive current if, when a supply voltage has reached a predetermined voltage, the enable signal is in the predetermined logic state.

3. A light emission control device comprising:

an external terminal via which a binary enable signal is fed in;

a counter counting the number of pulses in the enable signal by being triggered by every that edge in the enable signal which occurs when the enable signal turns from a second logic state to a first logic state, the counter outputting a resulting count as digital data;

a digital/analog converter converting the digital data into analog data and outputting the analog data;

a variable current source producing a drive current whose current level is based on the analog data, the variable current source supplying the drive current to a light-emitting element;

a period detector detecting whether or not the enable signal has remained in a same state for a predetermined period;

a voltage detector detecting whether or not a supply voltage has reached a predetermined voltage level;

an on/off controller comprising a D flip-flop receiving at a data terminal thereof a logic signal in the second logic state, receiving at a set terminal thereof an inverted signal of the enable signal, receiving at a reset terminal thereof an output signal of the period detector, and receiving at a clock terminal thereof an output signal of the voltage detector, an AND operator outputting an AND of an output signal of the on/off controller and the output of the voltage detector; and a switch controlling whether or not to supply the drive current to the light-emitting element based on an output signal of the AND operator, wherein the output signal of the on/off controller is fed to a reset terminal of the counter, to a reset terminal of the period detector, and to an enable terminal of the voltage detector.

4. A display device comprising:

a light-emitting element as a light source; and a light emission control device supplying a drive current to the light-emitting element, wherein the light emission control device comprises:

a current source producing the drive current;

a drive current controller controlling a current level of the drive current by controlling the current source based on the number of pulses in an enable signal;

a switch to open/close a supply path of the drive current to the light-emitting element; and a switch controller causing the switch to open/close according to the enable signal.

5. A drive control device supplying a predetermined drive current to a load, the drive control device comprising:

a current source producing the drive current;

an input terminal via which an external signal is fed in;

a drive current controller varying a current level of the drive current by controlling the current source every time a predetermined edge is recognized in the external signal;

a switch to open/close a supply path of the drive current to the load; and a switch controller causing the switch to open/close according to the external signal.

6. The drive control device of claim 5, further comprising:

a voltage monitoring circuit monitoring a supply voltage, wherein, after start-up of the drive control device, when the supply voltage has reached a predetermined voltage level, if the input terminal is in a first logic state, the drive current controller is so controlled as to stop the drive current, and if the input terminal is in a second logic state different from the first logic state, the drive current is kept at the current level set by the drive current controller.

7. The drive control device of claim 5, wherein the drive current controller comprises a counter circuit counting the number of times a predetermined edge is recognized in the external signal, and wherein, every time a predetermined edge is recognized in the external signal, the current level of the drive current is increased, when the predetermined edge has been recognized a predetermined number of times, the drive current stops being supplied, and thereafter when the predetermined edge starts being recognized again, every time the predetermined edge is recognized the current level of the drive current is increased.

8. The drive control device of claim 5, wherein the load is a light-emitting diode.

9. A light emission control device supplying a drive current to a light-emitting element, the light emission control device comprising:

a current source producing the drive current;

a drive current controller controlling a current level of the drive current by controlling the current source based on the number of pulses in an enable signal;

a switch to open/close a supply path of the drive current to the light-emitting element; and a resetter resetting control of the current level of the drive current and causing the switch to open when the enable signal has remained in a predetermined logic state for a predetermined period.

10. The light emission control device of claim 9, wherein the resetter comprises:

a period detection circuit measuring a period for which the enable signal has remained in the predetermined logic state;

an oscillation circuit feeding a clock signal to the period detection circuit; and a flip-flop circuit reset by an output of the period detection circuit, wherein, when the period for which the enable signal has remained in the predetermined logic state has reached the predetermined period, the resetter makes the drive current controller and the oscillation circuit stop operating by using the output of the period detection circuit.

* * * * *